US007367161B1

(12) United States Patent
Jones

(10) Patent No.: US 7,367,161 B1
(45) Date of Patent: May 6, 2008

(54) GATE OPENING AND CLOSING APPARATUS

(76) Inventor: Michael Wayne Jones, 2741 Cottonwood La., Pensacola, FL (US) 32514

( * ) Notice: Subject to any disclaimer, the term of this patent is extended or adjusted under 35 U.S.C. 154(b) by 571 days.

(21) Appl. No.: 10/834,821

(22) Filed: Apr. 30, 2004

(51) Int. Cl.
*E05F 15/02* (2006.01)

(52) U.S. Cl. ..... 49/334

(58) Field of Classification Search ..... 49/324, 49/326, 334, 333, 358, 139, 140; 256/1, 256/26, 24
See application file for complete search history.

(56) References Cited

U.S. PATENT DOCUMENTS

| | | | | |
|---|---|---|---|---|
| 2,311,967 | A | 2/1943 | Sawyer | |
| 2,561,623 | A | 7/1951 | Hall | |
| 2,582,666 | A | 1/1952 | Young | |
| 2,592,891 | A | 4/1952 | Hall | |
| 3,429,074 | A | 2/1969 | Horton | |
| 3,500,585 | A | 3/1970 | Vollmar | |
| 3,645,042 | A | 2/1972 | Bolli | |
| 3,839,826 | A | 10/1974 | Ries | |
| 3,988,860 | A | 11/1976 | Nevarez | |
| 4,231,190 | A | 11/1980 | Tieben | |
| 4,330,958 | A | 5/1982 | Richmond | |
| 4,403,449 | A | 9/1983 | Richmond | |
| 4,416,085 | A | 11/1983 | Lybecker et al. | |
| 4,472,908 | A * | 9/1984 | Wanzl et al. | 49/334 |
| 4,638,597 | A | 1/1987 | Lybecker | |
| 4,658,543 | A | 4/1987 | Carr | |
| 4,665,650 | A | 5/1987 | Hall | |
| 4,667,440 | A | 5/1987 | Grace, Sr. | |
| 4,731,886 | A * | 3/1988 | Heinrich et al. | 49/334 |
| 4,735,018 | A | 4/1988 | Duncan et al. | |
| 4,750,295 | A | 6/1988 | Court et al. | |
| 4,782,628 | A | 11/1988 | Gaddis | |
| 4,934,203 | A | 6/1990 | Bailey et al. | |
| 5,035,082 | A | 7/1991 | Butler | |
| 5,101,595 | A | 4/1992 | Rhoades | |
| 5,123,204 | A * | 6/1992 | He | 49/334 |
| 5,373,664 | A | 12/1994 | Butler | |
| 5,752,344 | A | 5/1998 | Richmond | |
| 5,804,938 | A | 9/1998 | Richmond et al. | |
| 5,867,939 | A | 2/1999 | Merrill | |
| 5,869,940 | A | 2/1999 | Parsadayan | |
| 5,942,867 | A | 8/1999 | Richmond | |
| 6,176,044 | B1 * | 1/2001 | Nixon et al. | 49/334 |
| 6,256,928 | B1 | 7/2001 | Skeem | |
| 6,408,571 | B1 | 6/2002 | Trott | |

FOREIGN PATENT DOCUMENTS

| | | | |
|---|---|---|---|
| GB | 2265180 | A * | 9/1993 |

* cited by examiner

*Primary Examiner*—Jerry Redman
(74) *Attorney, Agent, or Firm*—Peter Loffler

(57) ABSTRACT

A gate opener has a gate that rotates between an open and a closed position in order to allow or retard ingress and egress through the gate. A plate is secured to the ground while a motor is secured to a post of the gate and is rotatably secured to the plate. Activation of the motor causes the post to rotate and thereby swing the gate open. Subsequent activation of the motor causes the post to counterrotate and thereby swing the gate closed. Appropriate limit switches delimit the arc of travel of the gate.

10 Claims, 4 Drawing Sheets

GATE OPENING AND CLOSING APPARATUS

BACKGROUND OF THE INVENTION

1. Field of the Invention

The present invention relates to an apparatus that automatically opens and closes a rotating gate assembly.

2. Background of the Prior Art

Gates are popular access control devices that help restrict vehicular and pedestrian traffic to a wide array of locations where control of such traffic is desired. Apartment complexes, houses, ranches, and various work sites are typical locations where gates are oftentimes found. Access control gates come in one of two broad categories.

Some gates are manual in that the gate must be opened and closed manually by an operator. A user opens the gate in order to allow a vehicle or a person to pass through the gate and thereafter closes the gate in order to again restrict access therethrough. Such gates are typically found in relatively remote locations, such as a side entrance to a ranch, wherein the frequency of ingress and egress through the gate is relatively sparse and in areas where an attendant is on duty to help control access through the gate. A military site and a delivery parking lot are examples of gate locations of the latter type.

The other major type of gates are automatic in that the gate, through an appropriate action of a user, automatically opens and closes. A user may use a remote control device, may punch in a code linked to a key pad, or swipe an access card, in order to activate the automatic opening or closing of the gate. Additionally, the gate may be activated by an operator on duty or by a person located at a site remote of the gate who has some form of audio or visual access to the gate area. Such persons operate the gate as they see fit depending on the nature of the person or vehicle desiring passage through the gate area.

Most automatic opening and closing gates fall into one of three types. Some automatic gates are sliding gates wherein the gate opens and closes by sliding or rolling back and forth through the gate access area. A motor controls the operation of the gate and is linked to the gate through some form of chain or gear drive, wherein upon activation of the motor the drive becomes operational and controls back and forth movement of the gate, or the motor is connected directly to the gate and has some form of drive wheels that allow the back and forth movement of the gate. Activation of the motor drives the wheels which move the gate in the appropriate direction. Such gates require a "pocket" to be available into which pocket the gate slides when it is opened. If appropriate space for such a pocket is unavailable, this type of gate is not a good candidate for access control.

A second type of gate is one that is raised and lowered in order to control access. Most of these types of gates are some form of swing arm that is raised to allow passage through the gate area and is lowered to restrict access. These types of gates, which tend to be relatively inexpensive, are often found at parking lots, roadway toll booths and railroad track crossings.

A third type of gate is a swinging gate that pivots between an open and a closed position. Typically, the pivoting of the gate is actuated by either a hydraulic or pneumatic piston or a solenoid rod wherein extension of the piston or solenoid rod places the gate into a closed position and retraction of the piston or solenoid rod swings the gate into an open position. These types of gates are often found at condominium parking lots and at exclusive houses and neighborhoods and are very popular. The problem with this type of gate lies in the actuation mechanism. The piston or solenoid that controls gate swing is located remote of the gate and is mechanically linked to the gate. Not only is this architecture less than aesthetically appealing, it requires additional real estate beyond that required for the gate to be set aside for the actuation device and its connecting hardware. Additionally, the piston or solenoid rod is exposed to the elements which tends to make the device more prone to failure and therefore such devices require relatively frequent maintenance in order to keep such devices properly operational. Furthermore, as the piston or solenoid rod is in an extended position whenever the gate is closed, the piston or rod can be bumped, nicked or otherwise jarred when in this position rendering the piston or rod unable to properly retract thereby preventing the gate from being opened and requiring a service call to repair the gate. Such rod or piston damage can be the result of passersby, falling objects such as a tree limb, or by wind loading. In any event, the users are inconvenienced by the lack of operability of the gate and the attendant repair costs.

In order to address these problems, swinging gates have been proposed wherein the gate swing is accomplished by the use of a motor that is housed within the main post of the gate. The motor, by being housed within the main post, is not exposed to the elements and is not subject to damage from outside influences such as falling objects and wind loading. As a result, the motor is less prone to fail from such influences. As the motor is located within the main post of the swinging gate, the need to provide additional real estate for the accuation and connection hardware is eliminated. However, the problem with such prior art devices is that they are unduly complex in design and construction making such devices relatively expensive to manufacture and maintain.

Therefore, there exists a need in the art for an automatic swinging gate that addresses the above-stated problems found in the art. Specifically, a gate opening and closing apparatus is needed wherein the gate actuation hardware is disposed within the main gate post in order to eliminate the unsightliness of the actuation mechanism and to eliminate the negative effects that can be occasioned from outside influences such as rain, wind, falling objects, and passersby. Such a gate opening and closing apparatus must be of relatively simple design and construction so that it is relatively inexpensive to manufacture, install and maintain.

SUMMARY OF THE INVENTION

The gate opening and closing apparatus of the present invention addresses the aforementioned needs in the art. The gate opening and closing apparatus has its actuation hardware disposed within the main gate post in order to eliminate the unsightliness of the actuation mechanism and its attendant need for dedicated real estate and to eliminate the negative effects that are occasioned from outside influences such as rain, wind, falling objects, and passersby. The gate opening and closing apparatus is of relatively simple design and construction making the device relatively inexpensive to manufacture, install and maintain.

The gate opening and closing apparatus of the present invention is comprised of a base plate secured to the ground. A gate is rotatably secured to the base plate via a bearing that is secured to the base plate. A motor is operatively connected to bearing assembly while a male coupling is operatively connected to the motor and a female coupling is mated with the male coupling and is connected to the gate. Upon activation of the motor, the bearing and the male coupling rotate causing the female coupling to rotate, in turn causing the gate to rotate such that upon subsequent activation of the motor, the bearing and the male coupling counterrotate. The motor is connected to the bearing by a rotational plate coupled to the motor, the rotational plate being received by the bearing via an appropriate race. The base plate has a pin that is received within a corresponding slot on the rotational plate in order to act as a physical limit device and also help stabilize travel of the gate. At least one ramp is located on the bearing while a pair of limit switches are located on the rotational plate in order to automatically delimit the activation of the motor.

BRIEF DESCRIPTION OF THE DRAWINGS

Similar reference numerals refer to similar parts throughout the several views of the drawings.

DESCRIPTION OF THE PREFERRED EMBODIMENT

Figure 1:
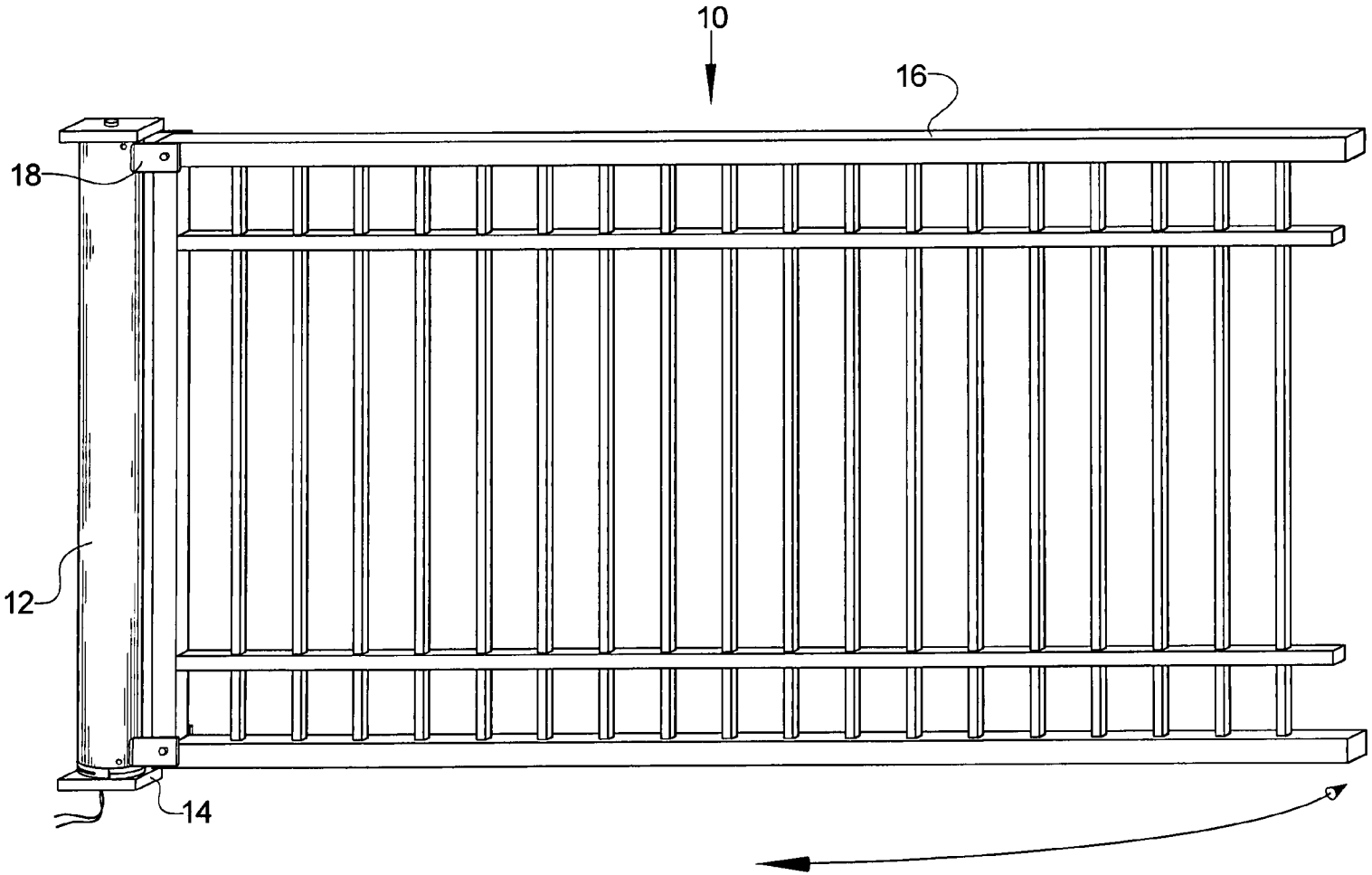
FIG. 1 is a perspective view of the gate opening and closing apparatus of the present invention.
Figure 2:
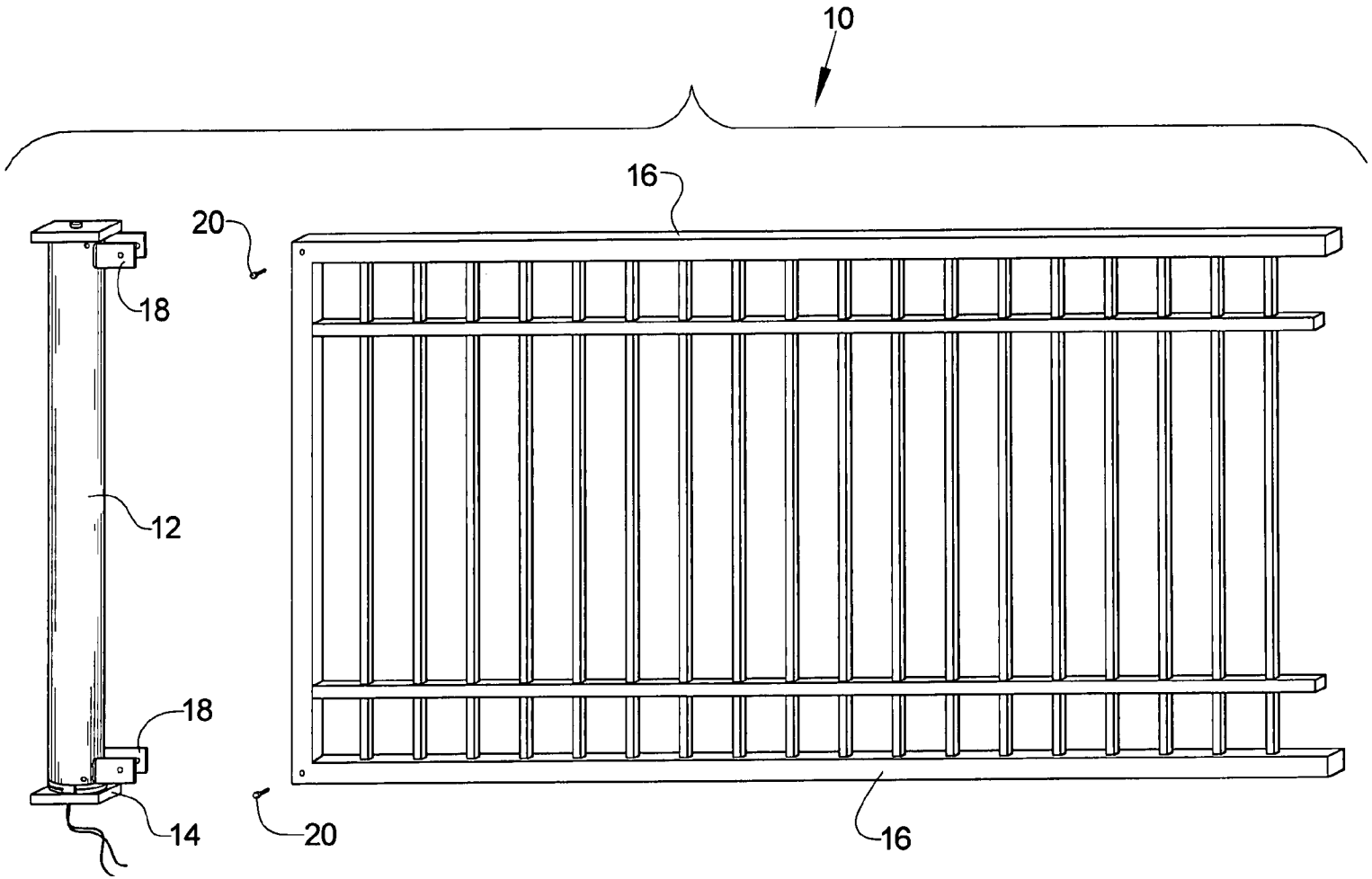
FIG. 2 is an exploded view of the exterior components of the gate opening and closing apparatus.
Figure 3:
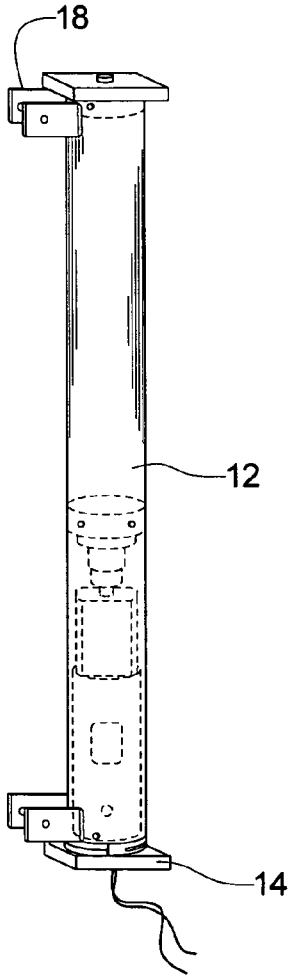
FIG. 3 is a perspective view of the swiveling post assembly of the gate opening and closing apparatus.
Figure 4:
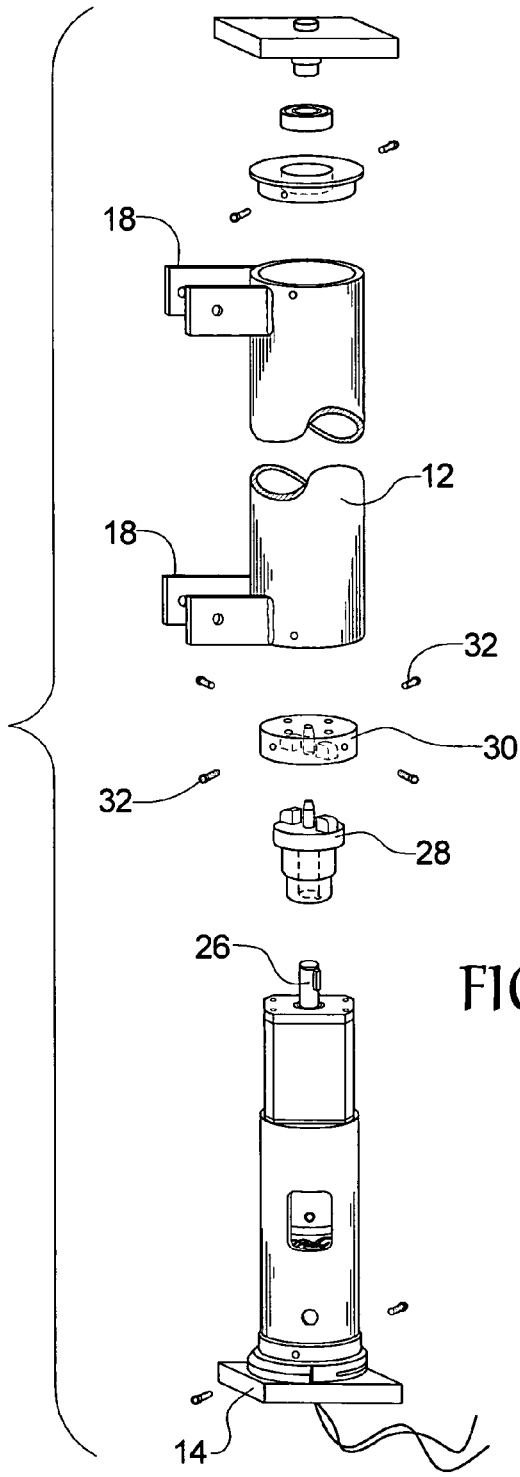
FIG. 4 is an exploded view of the swiveling post assembly.
Figure 5:
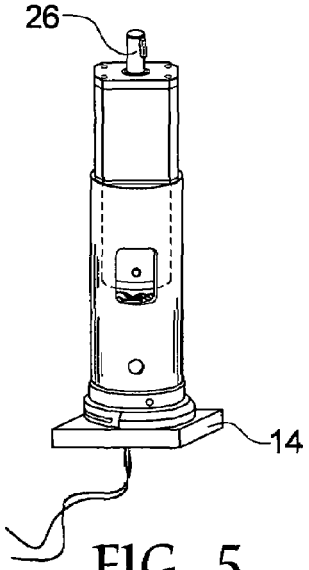
FIG. 5 is a perspective view of the motor and gear box assembly mated with the support cylinder.
Figure 6:
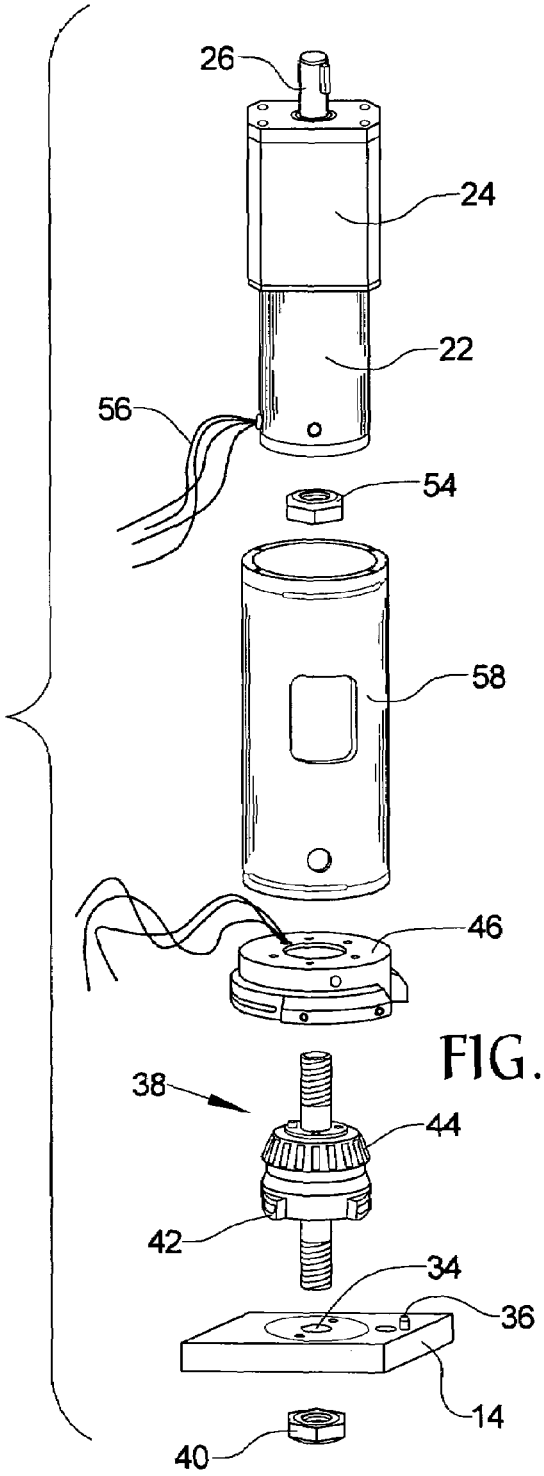
FIG. 6 is an exploded view of the components of FIG. 5.
Figure 7:
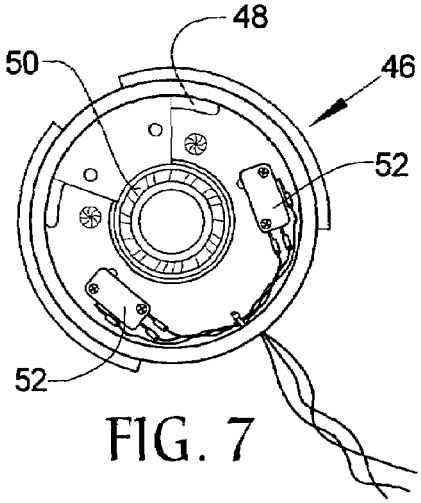
FIG. 7 is a bottom plan view of the rotational plate.

Referring now to the drawings, it is seen that the gate opening and closing apparatus of the present invention, generally denoted by reference numeral 10, is comprised of a post housing 12 that is secured rotatably connected to a base plate 14. The base plate 14 is secured to the ground in any appropriate fashion. A gate 16 is secured to the post housing 12 by appropriate brackets 18 located on the post housing 12 with pins 20 passing through the gate 16 and the and the brackets 18 for securing the gate thereto. The gate 16 is of any appropriate design such as the illustrated post gate, a lattice gate, etc. The gate 16 pivots with respect to the base plate 14 in order to allow the gate 16 to articulate between an open position allowing ingress and egress through the gate 16 and a closed position whereby ingress and egress through the gate is prevented.

As seen, rotation of the gate 16 with respect to the base plate 14 is accomplished by a motor assembly. Specifically, a motor 22, having an appropriate gear box 24, is disposed within the post housing 12 and has a shaft 26 that rotates in response to motor 22 activation. A male coupling 28 is located on an end of the shaft 26. A female coupling 30 matingly engages the male coupling 28 such that rotation of the male coupling 28 in response to motor 22 activation, causes rotation of the female coupling 30. The female coupling 30 is fixedly attached to the post housing 12 by appropriate fasteners 32 that attach the female coupling 30 with the post housing 12.

The base plate 14 has an opening 34 thereon and a guide pin 36. A bearing shaft assembly 38 is fixedly attached to the base plate 14 through the opening 34 and is held thereat by a lower retention nut 40. The bearing shaft assembly 38 has a pair of switch ramps 42 thereon and a bearing 44 that is an angular contact roller. A rotational plate 46 is positioned over the bearing shaft assembly 38 such that a slot 48 located on the lower surface of the rotational plate 46 receives the guide pin 36 on the base plate 14, which provides physical limit rotational control of the motor assembly with respect to the base plate 14. The bearing 44 of the bearing shaft assembly 38 is received by an appropriate bearing race 50 located on the rotational plate 46. A pair of limit switches 52 are located on the rotational plate 46 and are cooperatively engaged by the pair of ramps 42 located on the bearing shaft assembly 38 in order to delimit the arc of travel of the gate 16. The motor 22 is connected to the bearing shaft assembly 38 by an appropriate upper retention nut 54 so that output of the motor 22 is transferred to the bearing shaft assembly 38. Appropriate wiring 56 that is connected to a source of electrical power (not illustrated) is electrically connected to the motor 22 in order to provide operational power and control to the motor 22 and to the limit switches 52. A support cylinder 58 is provided to receive the motor 22 and sits atop the rotational plate 46.

In operation, the device 10 is assembled such that the base plate 14 is secured to the ground in any appropriate fashion. The bearing shaft assembly 38 is fixedly secured to the base plate 14 by the lower retention nut 40. The rotational plate 46 is secured atop the base plate 14 such that the guide pin 36 of the base plate 14 is received within the slot 48 of the rotational plate 46. The ramps 42 and the limit switches 52 are appropriately positioned on the bearing shaft assembly 38 and the rotational plate 46 respectively. The ramps 42 and limit switches 52 are cooperatively positioned on their respective components in order to define the arc of travel of the gate 16, which may, but is not necessarily limited to 90 degrees of arc travel. The motor 22 is mechanically coupled to the bearing shaft assembly 38 by the upper retention nut 54 and the support cylinder is appropriately positioned. The female drive coupling 30 is mated with the male drive coupling 28 and is attached to the post housing 12.

In operation, the gate 16 is placed into the closed position. In such a closed position, the pair of ramps 42 are aligned with the pair of limit switches 52 to define the close position. Upon activation of the motor 22, through an appropriate device such as depression of remote control switch, entry of the appropriate code into a key pad, swiping of a card through a card swiper, etc., which is operatively connected with the motor 22, the motor 22 is activated. Activation of the motor 22 causes rotation of the lower bearing 44 as well as the male coupling 28. Rotation of the lower bearing 44 continues until one of the ramps 42 aligns with one of the limit switches 52 which causes a cessation of motor 22 operation, the limit switches 52 and ramps 42 defining the arcuate travel limits of the gate 16. The pin 36 on the base plate 14 received within its respective slot 48 on the rotation plate 46 act as a physical stop limit and as a fail safe should the limit switch assembly fail (it being understood that various other physical limit stops can be used in keeping within the scope and spirit of the invention 10). Male drive coupling 28 rotation causes rotation of the female drive coupling 30, and as the female drive coupling 30 is attached to the post housing 12, the post housing 12 and its attached gate 16 are also rotated. This causes the gate 16 to be placed into the open position with the ramps 42 and the limit switches 52 defining the exact opening arc of the gate 16. Thereafter, either through user activation, or the expiration of an appropriate time limit, the gate 16 is closed. This is accomplished by having the motor 22 counterrotate until the pair of ramps 42 once again engage the pair of limit switches 52 which ceases operation of the motor 22. The motor 22 is now ready to once again rotate the gate 16 into the open position. An appropriate control device (not illustrated) is provided which controls input for causing the gate 16 to open and close (including appropriate timing logic, if timing control of gate closing is used). Such control circuitry also causes reversal of rotational direction of the motor 22 upon each ramp 42 encounter with the limit switches 52 so that the gate 16 opens and closes appropriately.

While the invention has been particularly shown and described with reference to an embodiment thereof, it will be appreciated by those skilled in the art that various changes in form and detail may be made without departing from the spirit and scope of the invention.

I claim:

1. A gate opener comprising:

a base plate secured to the ground;

a gate;

a bearing assembly that is secured to the base plate and supports the gate;

a motor operatively connected to the bearing assembly, the motor having an output shaft;

a male coupling operatively connected to the output shaft of the motor;

a female coupling mated with the male coupling, the female coupling connected to the gate; and such that activation of the motor causes the output shaft to rotate in a first direction causing the male coupling to rotate causing the female coupling to rotate, in turn causing the gate to rotate, the rotation of the gate female coupling continuing until a limit is reached causing the motor to cease activation and upon subsequent activation of the motor the output shaft of the motor rotates in a second direction that is opposite to the first direction causing the gate to counterrotate and such that the bearing assembly, the output shaft of the motor, the male coupling and the female coupling are all aligned on a common longitudinal axis.

2. The gate opener as in claim 1 wherein the motor is connected to the bearing assembly by a rotational plate coupled to the gate, the rotational plate received by the bearing assembly via a bearing race.

3. The gate opener as in claim 2 wherein the base plate has a pin that is received within a corresponding slot on the rotational plate.

4. The gate opener as in claim 2 further comprising:

at least one ramp located on the bearing assembly; and a pair of limit switches located on the rotational plate in order to act as the limit of the activation of the motor.

5. The gate opener as in claim 1 wherein the longitudinal axis is a vertical axis with respect to the ground.

6. A gate opener comprising:

a base plate secured to the ground;

a gate;

a bearing assembly that is secured to the base plate;

a motor operatively connected to bearing assembly the motor having an output shaft;

a male coupling operatively connected to the output shaft of the motor;

a female coupling mated with the male coupling, the female coupling connected to the gate; and wherein upon activation of the motor, the output shaft rotates in a first direction causing the male coupling to rotate causing the female coupling to rotate, in turn causing the gate to rotate, the gate supported on the bearing assembly the rotation of the female coupling continuing until a limit is reached causing the motor to cease activation and such that upon subsequent activation of the motor, the output shaft rotates in a second direction that is opposite the first direction and such that the bearing assembly, the output shaft of the motor, the male coupling and the female coupling are all aligned on a common longitudinal axis.

7. The gate opener as in claim 6 wherein the motor is connected to the bearing assembly by a rotational plate coupled to the motor, the rotational plate received by the bearing assembly via a bearing race.

8. The gate opener as in claim 7 wherein the base plate has a pin that is received within a corresponding slot on the rotational plate.

9. The gate opener as in claim 7 further comprising:

at least one ramp located on the bearing assembly; and a pair of limit switches located on the rotational plate in order to act as the limit of the activation of the motor.

10. The gate opener as in claim 6 wherein the longitudinal axis is a vertical axis with respect to the ground.

* * * * *